US006385794B1

(12) United States Patent
Miedzius et al.

(10) Patent No.: US 6,385,794 B1
(45) Date of Patent: May 14, 2002

(54) INTEGRATED EYE WASH AND SINK FAUCET

(75) Inventors: Chris Miedzius, Newark, DE (US); Robert S. Varney, Harleysville, PA (US); Imants Stiebris, Newark, DE (US)

(73) Assignee: Speakman Company, Wilmington, DE (US)

( * ) Notice: Subject to any disclaimer, the term of this patent is extended or adjusted under 35 U.S.C. 154(b) by 0 days.

(21) Appl. No.: 09/850,859

(22) Filed: May 8, 2001

(51) Int. Cl.[7] ..... A61H 35/02
(52) U.S. Cl. ..... 4/620; 4/675; 239/16
(58) Field of Search ..... 4/619, 620, 624, 4/675–678; 239/16, 445

(56) References Cited

U.S. PATENT DOCUMENTS

| | | | | |
|---|---|---|---|---|
| 3,090,050 A | | 5/1963 | Fraser et al. | |
| 3,265,082 A | | 8/1966 | Perlman | |
| 3,413,660 A | | 12/1968 | Lagarelli et al. | |
| 3,599,251 A | | 8/1971 | Wright | |
| 3,629,876 A | | 12/1971 | Wright | |
| 3,809,315 A | | 5/1974 | Wright | |
| 3,925,829 A | | 12/1975 | Bost | |
| 4,012,798 A | | 3/1977 | Liautaud | |
| 4,585,175 A | | 4/1986 | Formentos | |
| 4,675,924 A | | 6/1987 | Allison et al. | |
| 4,688,276 A | | 8/1987 | Allison et al. | |
| 5,170,518 A | | 12/1992 | Warriner | |
| 5,740,569 A | * | 4/1998 | Gurries, II et al. | 4/620 |
| 5,754,990 A | | 5/1998 | Gurries, II | |

* cited by examiner

*Primary Examiner*—Charles R. Eloshway
(74) *Attorney, Agent, or Firm*—Connolly Bove Lodge & Hutz LLP

(57) ABSTRACT

An integrated eye wash and sink faucet connected to cold and hot water supplies. The integrated eye wash and sink faucet includes a valve having a body with first and second openings provided therein, and a spindle having an arm integrally connected to a chamber. The spindle is slidably provided in the valve body. The first opening of the valve body is controllably in fluid communication with the cold and hot water supplies. The second opening of the valve body fluidly communicates with the cold water supply when the spindle chamber is provided at a predetermined location of the valve body. The integrated eye wash and sink faucet also has a sink faucet integrally formed with the valve body and in controlled fluid communication with the cold and hot water supplies, via the first opening of the valve body. Finally, the faucet of the present invention includes at least one eye wash spray nozzle connected to the valve body and in fluid communication with the cold water supply, via the second opening of the valve body, when the spindle chamber is provided at the predetermined location of the valve body.

14 Claims, 3 Drawing Sheets

28
30
34
36
32
40
38
12
16
18
13
20
22
23
24
4
200
Hot Water Supply
202
V
204
Cold Water Supply
206
210
14
26

Cold Water
Hot Water
Cold Water

INTEGRATED EYE WASH AND SINK FAUCET

BACKGROUND OF THE INVENTION

A. Field of the Invention

The present invention relates generally to eye wash stations and sink faucets, and, more particularly to an integrated eye wash and sink faucet.

B. Description of the Related Art

Emergency eye wash stations are required for employee safety in laboratories, factories, and warehouses where employees handle corrosive materials that may injure their eyes. Eye wash stations are also required in dentist offices. It is highly desirable that such eye wash stations be placed in an easily accessible location, and that the travel time to the eye wash station be limited and unobstructed.

Conventional eye wash stations provide water sprays from regular plant plumbing connections to a pair of spray nozzles. Upon activating the water flow, the water from the plant plumbing is fed to the spray nozzles to cause a spray of water from the nozzles. Such conventional eye wash stations typically require significant floor space that could be dedicated to factory tooling, making these eye wash stations undesirable.

On solution to this problem proposed by the related art is to provide eye wash attachments to existing sink faucets. For example, U.S. Pat. No. 5,170,518 describes a device with a rubber boot at one end and eye wash outlets at the other that can be attached to any existing faucet to convert the faucet into an eye wash station. U.S. Pat. Nos. 4,688,276 and 4,675,924 both disclose an eye wash attachment for a gooseneck faucet. A diverter valve enables transfer of faucet water (both hot and cold) to the attached eye wash nozzles. U.S. Pat. No. 3,925,829 discloses a dual faucet and eye wash arrangement wherein the eye wash rotates, diverting the faucet water (both hot and cold) from the faucet to the eye wash nozzles.

Unfortunately, none of these references discloses providing separate water supplies in a single faucet assembly, one for the sink faucet and one for the eye wash. Rather, these references disclose eye wash attachments that divert the water normally supplied to the sink faucet. Conventional water supplies for sink faucets provide both hot and cold water to the faucet. Thus, when such water supplies are diverted to the eye wash attachments disclosed in the related art, there is the potential for scalding of the eyes if the water is too hot.

Thus there exists a need in the art for an integrated eye wash and sink faucet that uses a separate cold water supply for the eye wash, prevents scalding to the eyes, occupies minimal space, and replaces existing sink faucets.

SUMMARY OF THE INVENTION

An object of the invention is to provide an integrated eye wash and sink faucet that uses an instantly-dedicated, separate cold water supply for the eye wash portion of the faucet.

A further object of the invention is to provide an integrated eye wash and sink faucet that prevents scalding to the eyes when the eye wash portion of the faucet is in use.

Another object of the invention is to provide an integrated eye wash and sink faucet that saves space by not taking up additional counter space.

A final object of the invention is to provide an integrated eye wash and sink faucet that can be used to replace existing sink faucets.

Additional objects and advantages of the invention will be set forth in part in the description which follows, and in part will be learned from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises an integrated eye wash and sink faucet connected to cold and hot water supplies. The integrated eye wash and sink faucet includes a valve having a body with first and second openings provided therein, and a spindle having an arm integrally connected to a chamber, wherein the spindle is slidably provided in the valve body. The first opening of the valve body is in controlled fluid communication with the cold and hot water supplies, wherein the second opening of the valve body is in fluid communication with the cold water supply when the spindle chamber is provided at a predetermined location of the valve body. The integrated eye wash and sink faucet further includes a sink faucet integrally formed with the valve body and in fluid communication with the cold and hot water supplies via the first opening of the valve body. Finally, the integrated eye wash and sink faucet includes at least one eye wash spray nozzle connected to the valve body and in fluid communication with the cold water supply, via the second opening of the valve body, when the spindle chamber second opening is provided at the predetermined location of the valve body.

It is to be understood that both the foregoing general description and the following detailed description are exemplary and explanatory only and are not restrictive of the invention, as claimed.

DESCRIPTION OF THE DRAWINGS

The accompanying drawings, which are incorporated in and constitute a part of this specification, illustrate one embodiment of the invention and together with the description, serve to explain the principles of the invention. In the drawings.

DESCRIPTION OF THE PREFERRED EMBODIMENT

Reference will now be made in detail to the present preferred embodiment of the invention, an example of which is illustrated in the accompanying drawings. Wherever possible, the same reference numbers will be used throughout the drawings to refer to the same or like parts.

accordance with the invention, the present invention is broadly drawn to an integrated eye wash and sink faucet connected to cold and hot water supplies. The eye wash faucet is connected solely to the cold water supply for use during emergencies. The sink faucet is connected to both the cold and hot water supplies for conventional sink use.

Figures 1, 2:
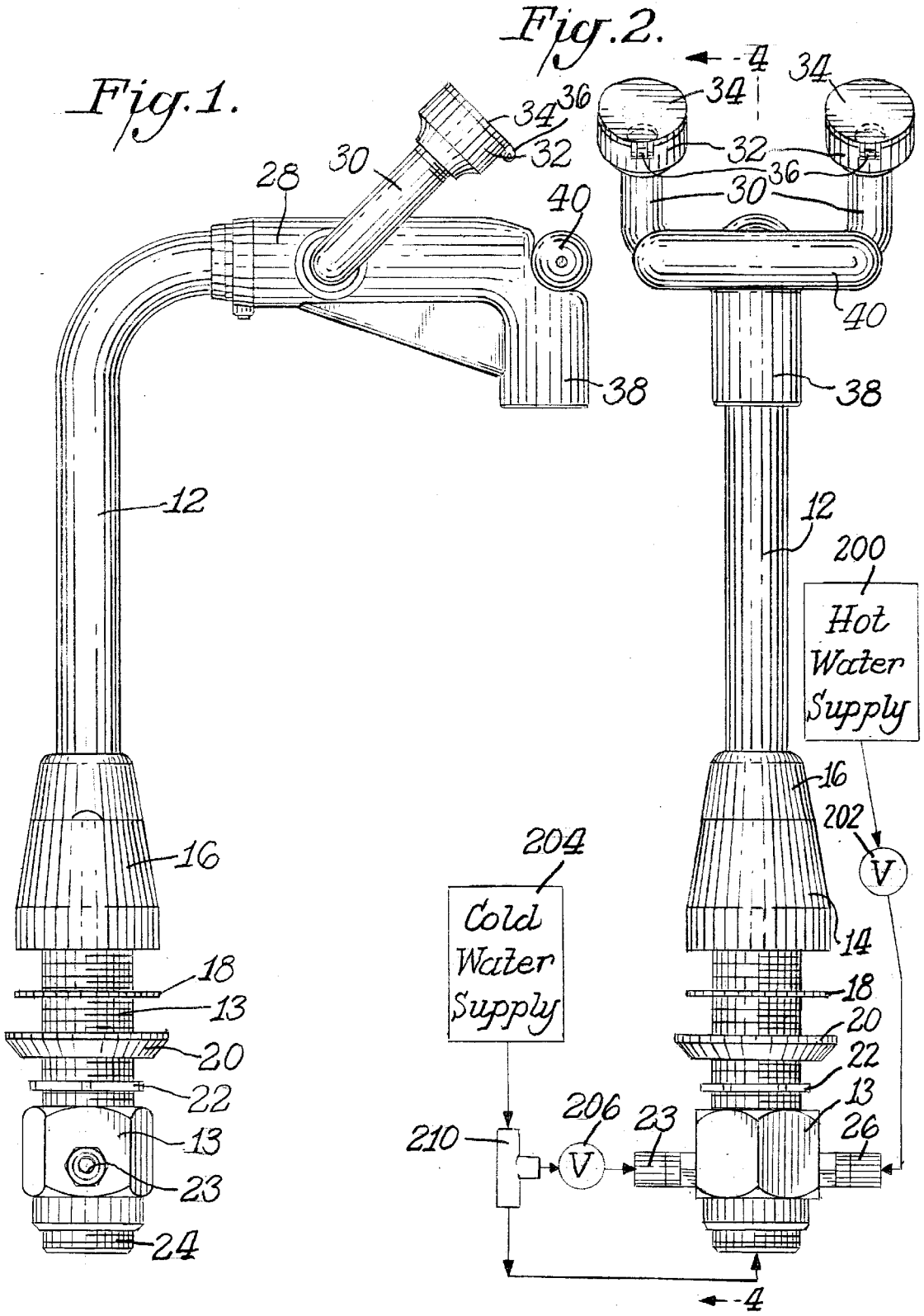
FIG. 1 is a side elevational of an integrated eye wash and sink faucet in accordance with a preferred embodiment of the present invention.
FIG. 2 is a front elevational view of the integrated eye wash and sink faucet shown in FIG. 1.
Figure 3:
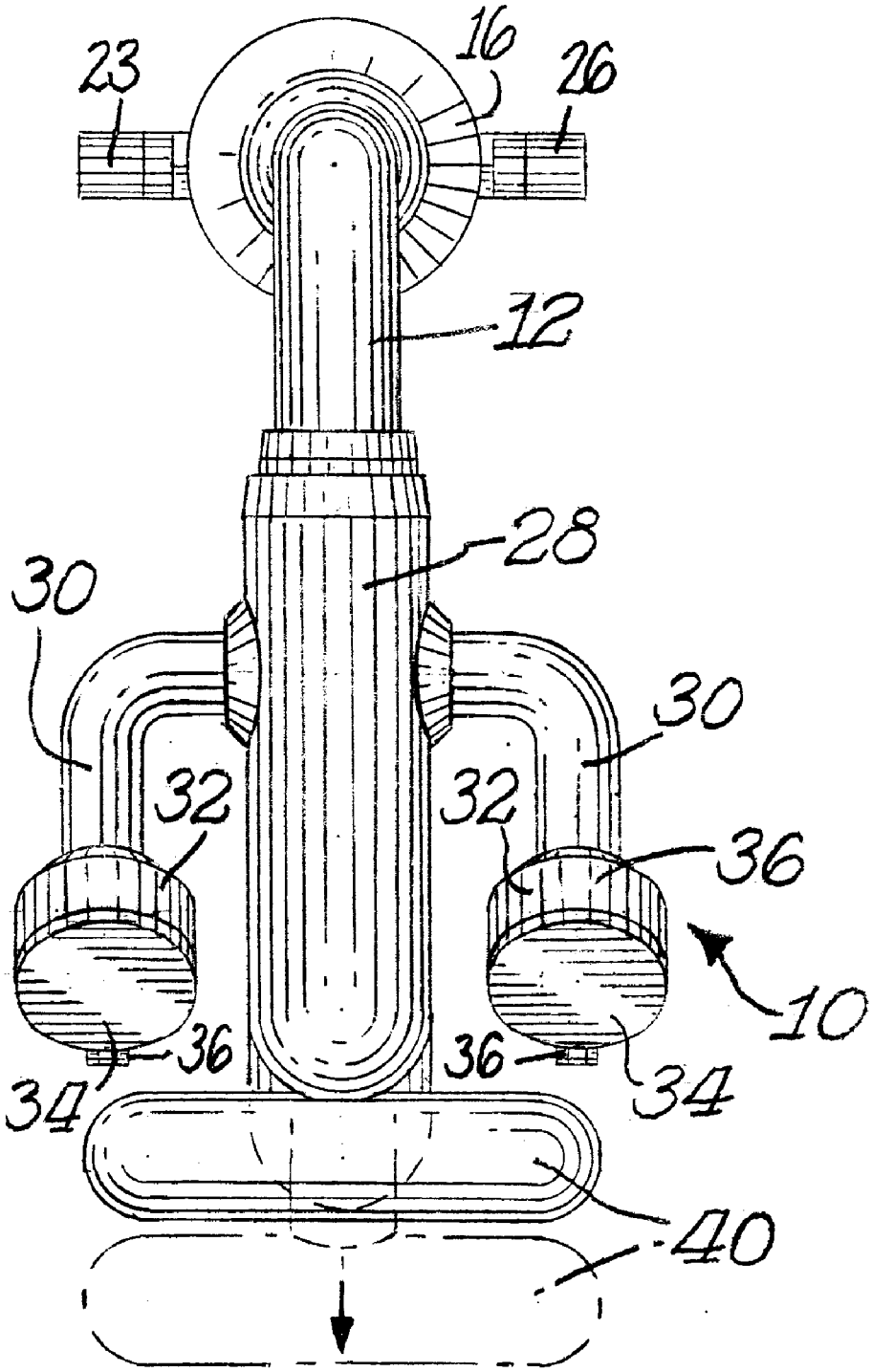
FIG. 3 is a top plan view of the integrated eye wash and sink faucet shown in FIG. 1.

More specifically and as shown in FIGS. 1–3, the integrated eye wash and sink faucet 10 of the present invention includes a fluid communicating means such as a gooseneck pipe 12, an adapter 13, a flange 14, a top collar 16, a washer 18, a bottom cup washer 20, and a nut 22. The adapter 13 includes a cold water inlet 24 for the eyewash, a cold water inlet 23 for the faucet and a hot water inlet 26 for the faucet. The flange 14, washer 18, bottom cup washer 20, and the nut 22 secure the threaded section of the flange 14 and facilitate connection of gooseneck pipe 12 to an existing sink basin (not shown). The gooseneck pipe 12 connects to an existing sink basin by providing flange 14 through an opening formed in the sink basin. The top surface of the sink basin engages the flange 14 via washer 18, and the bottom surface of the sink basin engages bottom collar 20. Nut 22 is then tightened to firmly hold the sink basin between top collar 16 and the bottom collar.

As further shown in FIGS. 1–3, the integrated eye wash and sink faucet 10 of the present invention includes a valve assembly having a valve body 28 connected to gooseneck pipe 12. Two eye wash branch lines 30 connect to valve body 28, each branch line 30 terminating in a corresponding eye wash spray nozzle 32. Each eye wash spray nozzle 32 preferably includes a dust cover 34 to protect eye wash spray nozzle 32 from airborne contaminants when not in use. The dust cover 34 shown in FIG. 1 is may be a hinged dust cover having a hinge 36 that permits dust cover 34 to flip open when water flows through eye wash spray nozzle 32. Alternatively, a dust cover and chain assembly may be used with the present invention. Such a dust cover is described in U.S. Pat. No. 4,585,175, assigned to the assignee of the present invention, Speakman Company. Valve body 28 is integrally formed with a sink faucet 38 that provides hot and cold water in a manner similar to conventional sink faucets. A pull handle 40 extends above sink faucet 38 and from valve body 28. Pull handle 40 activates water flow through eye wash spray nozzles 32, as will be described below.

Fluid connection of integrated eye wash and sink faucet 10 to existing water supplies is best shown in FIG. 2. A hot water supply 200 is in fluid communication with a conventional sink valve 202, and a cold water supply 204 is in fluid communication with another conventional sink valve 206. Hot water valve 202 connects to the threaded connection 26 on the adapter 13. Cold water 206 connects to the threaded connection 23 on the adapter 13. These valves operate in a convention manner. That is, hot and cold water valves 202, 206 may be manipulated to provide only cold water, only hot water or a combination of cold and hot water to the adapter 13, and accordingly, to the sink faucet 38. Cold water is directly and continuously supplied cold water inlet 24 from cold water supply 204.

Figures 4, 5, 6:
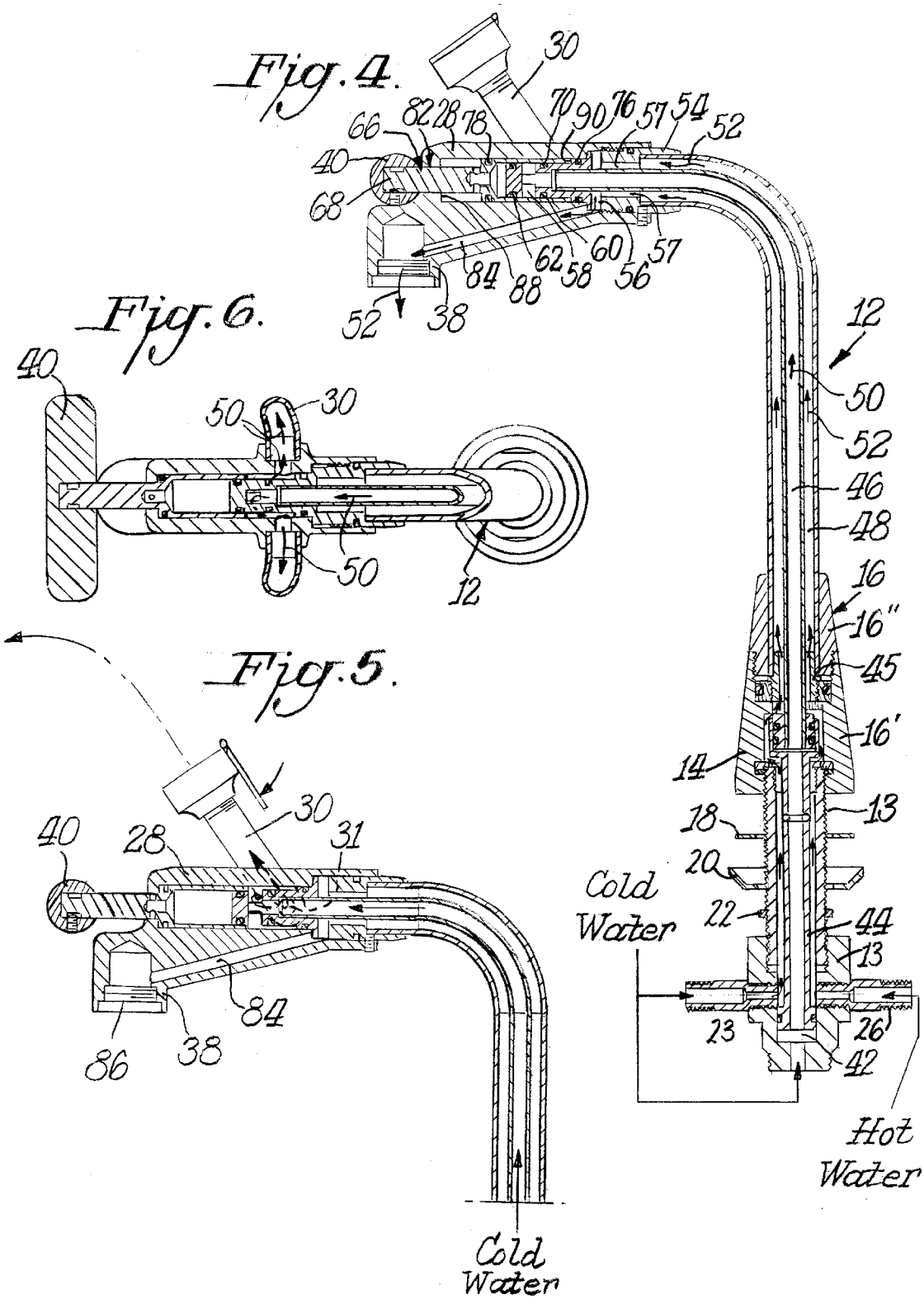
FIG. 4 is a cross-sectional side elevational view of the preferred embodiment of the integrated eye wash and sink faucet taken along line 4—4 of FIG. 2, and showing the eye wash in a closed position.
FIG. 5 is an enlarged cross-sectional side elevational partial view of the integrated eye wash and sink faucet shown in FIG. 4, and showing the eye wash in an open position.
FIG. 6 is a cross-sectional top plan view of the integrated eye wash and sink faucet shown in FIG. 5.

FIG. 4 is a cross-sectional side-elevated view of the integrated eye wash and sink faucet 10. As shown, the assembly of connecting adapter 13 and flange 14 form dual conduits: a primary conduit 42 in fluid communication with cold water inlet 24, a second conduit 44 in fluid communication with the cold 23 and hot inlet 26. Top collar is a two-piece arrangement having a bottom portion 16' and a top portion 16". Positioned on gooseneck pipe 12 is a connecting collar 45 that retains top collar 16" onto gooseneck pipe 12. Top portion 16" threadably engages bottom portion 16' securing the gooseneck pipe 12 to the sink basin. A cold water passageway 46 and cold and hot water passageway 48 are provided within an outer housing 12' of gooseneck pipe 12. Cold water passageway 46 is in fluid communication with primary conduit 42 of stem 12, providing a path for only cold water 50 to the eye wash spray nozzles 32. Likewise, cold and hot water passageway 48 is in fluid communication with secondary conduit 44 of stem 12, providing a path for cold water alone, hot water alone, or mixed cold and hot water 52 to sink faucet 38.

As further shown in FIG. 4, a dual water passage adapter 54 connects to the outer periphery of gooseneck pipe 12 and threadably engages the inner periphery of valve body 28. Adapter 54 has a cold and hot water opening 56 and passageway 57 provided therein that fluidly communicates with cold and hot water passageway 48. Secondary conduit 44, cold and hot water passageway 48, cold and hot water opening 56, and passageway 57 are in controlled fluid communication with cold and hot water supplies 204, 200. These elements are in "controlled" fluid communication with water supplies 204, 200 in that valves 202, 206 may be manipulated by a user to control the supplies of cold and hot water. Adapter 54 further includes cold water opening 58 provided therein that fluidly connects to cold water passageway 46. Finally, adapter 54 has a plurality of O-rings 60, 62 provided around its periphery to prevent water leakage from adapter 54.

A spindle 66, also provided within valve body 28, comprises an arm 68 integrally connected to a cylindrical chamber 70. Spindle 66, adapter 54 and valve body 28 make up the complete valve assembly of the present invention. Spindle arm 68 connects to pull handle 40 and is slidably provided within a through hole 82 provided within valve body 28. Cylindrical chamber 70 slidably engages the outer periphery of adapter 54 and the inner periphery of valve body 28. Cylindrical chamber 70 fluidly connects cold water opening 58 of adapter 54 to outlet ports 31 of eye wash branch lines 30 when pull handle 40 and spindle 66 are pulled away from integrated eye wash and sink faucet 10 and chamber 70 engages aback wall 88 of valve body 28. When chamber 70 engages the back wall 88 of valve body 28, the valve assembly is in its open position. Alternatively, when spindle chamber 70 engages or is adjacent to a wall 90 of adapter 54, the valve assembly is in its closed position. When the valve assembly is in its closed position, as shown in FIG. 4, outlet ports 31 of branch lines 30 are not in fluid communication with cold water opening 58, preventing cold water 50 from reaching eye wash spray nozzles 32. Cold and hot water opening 56 of adapter 54 fluidly connects cold and hot water 52 (as controlled by valves 206, 202) to sink faucet 38, via a sink passageway 84, when the valve assembly is in either its open or closed position. A plurality of O-rings 76, 78 are provided around the outer periphery of spindle cylindrical chamber 70 to prevent water from leaking from chamber 70.

The integrated eye wash and sink faucet of the present invention further includes sink faucet 38 that is integrally formed with valve body 28. Sink faucet 38 has a sink passageway 84 connected to a sink faucet spray head 86. Sink faucet 38 fluidly connects to hot and cold water supplies 200, 204 to provide cold water, hot water, or a mixture of the two in a conventional manner.

In normal faucet operation, when the valve assembly is in its closed position as shown in FIG. 4, outlet ports 31 of branch lines 30 are not connected to adapter cold water opening 58. This prevents cold water from reaching eye wash spray nozzles 32. However, cold and hot water opening 56 may be fluidly connected to sink passageway 84 and sink faucet spray head 86, as long either valve 206, valve 202, or both valves are open. Assuming one or both valves 206, 202 are open, cold and/or hot water 52 flows through passageway 48, passageway 57, cold and hot water opening 56, and sink passageway 84, and exits through sink faucet spray head 86. Thus, a user may manipulate the hot and cold water valves 202, 206 in a conventional manner to provide water flow (cold, hot, or cold/hot mixture) to sink faucet spray head 86.

During emergency faucet operation as shown in FIGS. 5 and 6, a user moves pull handle 40 and spindle 66 away from valve body 28, setting the valve assembly in the open position. Outlet ports 31 of branch lines 30 connect to the cold water opening 58 of adapter 54. Cold water 50 flows through cold water passageway 46, cold water opening 58 of adapter 54, outlet ports 31, to eye wash branch lines 30, and exits through eye wash spray nozzles 32. Cold water 50 flushes the user's eyes in a manner similar to conventional eye wash stations. The integrated eye wash and sink faucet 10 of the present invention, thus provides an instantly-dedicated, separate cold water supply to eye wash spray nozzles 32.

The integrated eye wash and sink faucet 10 of the present invention may be used to replace existing sink faucets, by removing and replacing the existing sink faucet with the integrated eye wash and sink faucet 10 of the present invention. The present invention, therefore, provides an integrated eye wash and sink faucet that saves space by not taking up additional counter space.

It will be apparent to those skilled in the art that various modifications and variations can be made in the integrated eye wash and sink faucet of the present invention and in construction of this integrated eye wash and sink faucet without departing from the scope or spirit of the invention. As an example, faucet pipe 12 need not be a gooseneck configuration, but rather the present invention could any faucet pipe configuration, as long as a dual water supply is provided therein.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An integrated eye wash and sink faucet connected to cold and hot water supplies, the integrated eye wash and sink faucet comprising:

a valve having a body with first and second openings provided therein, and a spindle having an arm integrally connected to a chamber, the spindle being slidably provided in the valve body, the first opening of the valve body being in controlled fluid communication with the cold and hot water supplies, wherein the second opening of the valve body is in fluid communication with the cold water supply only when the spindle chamber is provided at a predetermined location of the valve body;

a sink faucet integrally formed with the valve body and in fluid communication with the cold and hot water supplies via the first opening of the valve body; and at least one eye wash spray nozzle connected to the valve body and in fluid communication with the cold water supply only, via the second opening of the valve body, when the spindle chamber is provided at the predetermined location of the valve body.

2. The integrated eye wash and sink faucet as recited in claim 1, wherein the spindle chamber is provided at the predetermined location of the valve body when the spindle chamber engages a back wall of the valve body.

3. The integrated eye wash and sink faucet as recited in claim 1, wherein two eye wash spray nozzles are connected to the valve body.

4. The integrated eye wash and sink faucet as recited in claim 1, further comprising:

an adapter connected to the valve body and the cold and hot water supplies, the adapter having a first opening in controlled fluid communication with the cold and hot water supplies, via the first opening of the valve body, the adapter having a second opening in fluid communication with the cold water supply and the second opening of the valve body when the spindle chamber is provided at the predetermined location of the valve body.

5. The integrated eye wash and sink faucet as recited in claim 4, wherein the spindle chamber is provided at the predetermined location of the valve body when the spindle chamber engages a back wall of the valve body.

6. The integrated eye wash and sink faucet as recited in claim 4, wherein fluid communication ceases between the second opening of the valve body and the cold water supply when the spindle chamber engages a wall of the adapter.

7. The integrated eye wash and sink faucet as recited in claim 4, wherein two eye wash spray nozzles are connected to the valve body.

8. The integrated eye wash and sink faucet as recited in claim 1, further comprising:

a pipe having a first passageway in controlled fluid communication with the cold and hot water supplies, via the first opening of the valve body, and a second passageway in fluid communication with the cold water supply and the second opening of the valve body when the spindle chamber is provided at the predetermined location of the valve body.

9. The integrated eye wash and sink faucet as recited in claim 8, wherein the spindle chamber is provided at the predetermined location of the valve body when the spindle chamber engages a back wall of the valve body.

10. The integrated eye wash and sink faucet as recited in claim 8, wherein two eye wash spray nozzles are connected to the valve body.

11. An integrated eye wash and sink faucet connected to cold and hot water supplies, the integrated eye wash and sink faucet comprising:

a valve having a body with first and second openings provided therein, and a spindle having an arm integrally connected to a chamber, the spindle being slidably provided in the valve body;

an adapter connected to the valve body and the cold and hot water supplies and having first and second openings provided therein;

a pipe connected to the adapter and the cold and hot water supplies and having first and second passageways provided therein;

a sink faucet integrally formed with the valve body and in controlled fluid communication with the cold and hot water supplies, via the first openings of the valve body and the adapter, and the first pipe passageway; and at least one eye wash spray nozzle connected to the valve body and in fluid communication with the cold water supply only, via the second openings of the valve body and the adapter, and the second pipe passageway, when the spindle chamber is provided at the predetermined location of the valve body.

12. The integrated eye wash and sink faucet as recited in claim 11, wherein the spindle chamber is provided at the predetermined location of the valve body when the spindle chamber engages a back wall of the valve body.

13. The integrated eye wash and sink faucet as recited in claim 11, wherein two eye wash spray nozzles are connected to the valve body.

14. The integrated eye wash and sink faucet as recited in claim 11, wherein fluid communication ceases between the second opening of the valve body and the cold water supply when the spindle chamber engages a wall of the adapter.

* * * * *